US006569827B2

(12) United States Patent
Van Dijk et al.

(10) Patent No.: US 6,569,827 B2
(45) **Date of Patent: *May 27, 2003**

(54) CONCENTRATED LIQUID DETERGENT COMPOSITION

(75) Inventors: Willem Robert Van Dijk, Vlaardingen (NL); Theresia Maria Olsthoorn, Vlaardingen (NL); Marja Ouwendijk, Hellevoetsluis (NL); Johannes Cornelis van de Pas, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/880,237

(22) Filed: Jun. 13, 2001

(65) Prior Publication Data

US 2002/0019326 A1 Feb. 14, 2002

(30) Foreign Application Priority Data

Jun. 15, 2000 (EP) ..... 00202093

(51) Int. Cl.[7] ..... C11D 3/00

(52) U.S. Cl. ..... 510/392; 510/392; 510/311; 510/376; 510/500

(58) Field of Search ..... 510/392, 311, 510/376, 500

(56) References Cited

U.S. PATENT DOCUMENTS

| | | | | |
|---|---|---|---|---|
| 4,462,922 A | | 7/1984 | Boskamp | 252/174.12 |
| 4,532,064 A | | 7/1985 | Boskamp | 252/105 |
| 5,952,278 A | | 9/1999 | Mao et al. | 510/235 |
| 5,955,415 A | * | 9/1999 | Gutierrez et al. | 510/312 |
| 6,218,351 B1 | * | 4/2001 | Busch et al. | 510/311 |

FOREIGN PATENT DOCUMENTS

| | | |
|---|---|---|
| EP | 462 460 | 12/1971 |
| EP | 533 239 | 3/1993 |

OTHER PUBLICATIONS

PCT International Search Report in a PCT/EP application PCT/EP 01/05708.

* cited by examiner

*Primary Examiner*—Mark Kopec
*Assistant Examiner*—Eisa B Elhilo

(57) ABSTRACT

A physically stable, concentrated isotropic liquid detergent composition comprises (a) from 10 to 70% of an anionic, nonionic, cationic, zwitterionic active detergent material or mixtures thereof, (b) from 0.0001 to 10% of protease; (c) from 2 to 40% of at least one carbohydrate selected from oligosaccharides, polysaccharides and derivatives thereof, wherein n=1–5, and (d) less than 3% of an antioxidant selected from the group consisting of alkalimetalsulphites, alkalimetalbisulphites, alkalimetabisulphites or alkalimetalthiosulphates.

13 Claims, No Drawings

CONCENTRATED LIQUID DETERGENT COMPOSITION

FIELD OF THE INVENTION

The present invention relates to an enzymatic liquid detergent composition with good enzyme-stability. In particular, the present invention concerns a concentrated and physically stable isotropic liquid detergent composition with good protease stability suitable for cleaning textile articles.

BACKGROUND OF THE INVENTION

In general, isotropic compositions are clear liquids wherein all the ingredients are dissolved. Concentrated isotropic liquid detergent compositions are very efficient in use and require less package and transport costs per wash. However, the high concentration of cleaning-effective ingredients is often problematic. One problem is to formulate a composition that is physically stable over a prolonged period of time as the highly concentrated surfactants tend to aggregate and separate out. This causes the composition to become hazy and physically unstable. Moreover, because other ingredients in the composition are also present in high concentrations, these ingredients may also separate out themselves or cause other ingredients to become insoluble.

Yet another problem is to ensure a sufficient storage-stability of the enzyme in concentrated liquid detergent compositions, particularly when protease is used. The prior art has already described various ways in which this problem can be overcome, e.g. by encapsulating the enzymes or by inclusion of enzyme-stabilising systems in such liquid detergent compositions. For example, glycerol/borax is a well-known enzyme stabilising system but, unfortunately, it is rather costly.

WO-A-98/40471 describes a method to improve the storage stability of dissolved laccase, an enzyme that catalyses the oxidation of phenol of which the reaction products can be used for dyeing hair or fabrics. The laccase is dissolved in water and sorbitol. There is no mention of the effect of carbohydrates on protease deactivation and the descriptions does not relate to isotropic liquid detergent compositions for the cleaning of fabrics.

U.S. Pat. No. 5,288,746 relates to liquid laundry detergent composition wherein glucose and glucose oxidase are used for the generation of hydrogen peroxide. To prevent premature hydrogen peroxide generation in the composition Cu2+ or Ag+ ions are incorporated in the composition. Therefore, glucose is not used as enzyme stabilising system but as a substrate for the enzyme.

EP-A-381 262 relates to the stabilisation of lipase in liquid detergent compositions with sorbitol and borax. Sorbitol is relatively expensive and there is a need for more economic alternatives.

U.S. Pat. No. 4,462,922 describes a liquid detergent wherein a mixture of glycerol, boron compound and an antioxidant containing sulphur is used to produce an enzyme-stabilising effect. For this mixture the antioxidant must be present above a certain level, as well as the boric acid or the alkali metal borate. The antioxidant should be present in the mixture in an amount of at least 5% by weight of the final enzymatic aqueous liquid detergent composition, and the boric acid or alkali metal borate in an amount of at least 2% by weight of the final enzymatic aqueous liquid detergent composition. The antioxidant is an alkalimetalsulphites, alkalimetalbisulphites, alkalimetabisulphites or alkalimetalthiosulphates.

However, this prior art composition is less desirable because sulphite salts tend to produce an unpleasant odour. Furthermore, applicants have found that it is problematic to incorporate the enzyme stabilising system of U.S. Pat. No. 4,462,922 in a concentrated isotropic liquid detergent because this leads to a hazy liquid which is no longer isotropic.

Surprisingly, we have now found that one or more of these problems can be overcome by the present invention while maintaining good protease stability.

DEFINITION OF THE INVENTION

Accordingly, the present invention provides a physically stable concentrated isotropic liquid detergent composition comprising (a) from 10 to 70% of surfactant selected from anionic, nonionic, cationic, zwitterionic active detergent material or mixtures thereof, (b) from 0.001 to 10% of protease;

(c) from 2 to 40% of at least one carbohydrate selected from oligosaccharides, polysaccharides and derivatives thereof; and (d) less than 3% of an antioxidant selected from the group consisting of alkalimetalsulphites, alkalimetalbisulphites, alkalimetabisulphites or alkalimetalthiosulphates.

Furthermore, the present invention encompasses a method for the stabilisation of protease in a physically stable concentrated isotropic liquid detergent composition comprising the steps of (I) formulating an said composition comprising
  (a) from 10 to 70% of an anionic, nonionic, cationic, zwitterionic active detergent material or mixtures thereof,
  (b) from 0.0001% to 10% of protease; and
  (c) less than 3% of an antioxidant selected from the group consisting of alkalimetalsulphites, alkalimetalbisulphites, alkalimetabisulphites or alkalimetalthiosulphates, and (II) adding 2 to 40% of at least one carbohydrate selected from oligosaccharides, polysaccharides and derivatives thereof, to the composition prepared in step (1).

One of the advantages of the present invention is that it provides a stable isotropic detergent composition that is simple to formulate and offers a significant cost advantage compared to glycerol/borax system.

A further advantage of the inventive composition is that the carbohydrate can be incorporated up to at least 20 wt % without causing physical stability problems.

The inventive composition comprises less than 3 wt %, more preferably less than 2 wt %, most preferably less than 1 wt % of the antioxidant selected from the group consisting of alkalimetalsulphites, alkalimetalbisulphites, alkalimetabisulphites or alkalimetalthiosulphates.

Isotropic liquid detergent composition are defined for the present purpose as liquid detergent compositions wherein the surfactants do not form liquid crystalline phases, like multi-lamellar droplets of surfactant material. Isotropic liquids are generally not birefringent under static conditions but may be birefringent under flow.

For the purpose of this invention a composition is physically stable when less than 2% phase separation occurs after 2 week storage at 37° C. With isotropic liquids this can be phase separation generally starts with the liquid becoming hazy.

Carbohydrate

The carbohydrate is selected from oligosaccharides and polysaccharides e.g. having up to 30 carbon atoms, and derivatives thereof. The term "oligomer" is usually taken to encompass dimers, trimers and tetramers. Oligosaccharides and their derivatives are especially preferred carbohydrates for use in the present invention, disaccharides, trisaccharides and derivatives thereof, being especially preferred.

One preferred class of preferred carbohydrates comprises the group comprising trisaccharides with a free hemiacetal group. Typical examples of this category are: Cellotriose (β-D-glucopyranosyl-(1→4)-β-D-glucopyranosyl-(1→4)-D-glucopyranose. Even more preferred are the trisaccharides without a free hemiacetal group (the so-called non-reducing trisaccharides). Typical example of this category is raffinose (β-D-Fructofuranosyl α-D-galactopyranosyl-(1→6)-α-(-D-glucopyranoside).

The most preferred carbohydrate comprises the disaccharides of non-mammalian origin. This does not include milk sugar lactose. More specifically the disaccharides with a free hemiacetal group (the so-called reducing disaccharides. Typical examples of this category are: Cellobiose (β-D-glucopyranosyl-(1→4)-D-glucose) β-maltose (α-D-glucopyranosyl-(1→4)-β-D-glucopyranose).

The most preferred disaccharides are compounds without a free hemiacetal group (the so-called non-reducing disaccharides. Typical disaccharides of the last category, are: Sucrose (β-D-Fructofuranosyl α-D-glucopyranoside) Trehalose (α-D-Glucupyranosyl α-D-glucopyranoside).

The composition herein preferably comprises 5–30%, more preferably 8–25% of at least one carbohydrate.

Additional Enzyme Stabilising System

In most cases the inventive composition will not need an additional measure to stabilise the enzyme. However, if needed small amounts of additional stabilising systems can be added, for example, those comprising, boric acid, propylene glycol, short chain carboxylic acids, boronic acids, and mixtures thereof, designed to address different stabilisation problems depending on the type and physical form of the detergent composition.

Another stabilising approach is by use of borate species. See Severson, U.S. Pat. No. 4,537,706. Borate stabilisers, when used, are preferably present in an amount of more than 0.1 and less than 5%, preferably less than 3%, more preferably less than 2.5% by weight of boric acid. Other borate compounds may be used such as borax or orthoborate suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Enzymes

"Detersive enzyme", as used herein, means any enzyme having a cleaning, stain removing or otherwise beneficial effect in a laundry application. Enzymes are included in the present detergent compositions for a variety of purposes, including removal of protein-based, carbohydrate-based, or triglyceride-based stains, for the prevention of refugee dye transfer, and for fabric restoration. Suitable enzymes include proteases, amylases, lipases, cellulases, peroxidases, and mixtures thereof. The enzyme may be of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorising, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.0001% to 10%, preferably from 0.001% to 5%, more preferably 0.005%–1% by weight of a commercial enzyme preparation.

The protease enzymes utilised in the present invention are usually present in such commercial preparations at levels sufficient to provide from 0.005 to 0.1 Anson units (AU) of activity per gram of composition. Protease enzymes are usually present in such commercial preparations at levels sufficient to provide from 0.005 to 0.1 Anson units (AU) of activity per gram of composition.

Suitable examples of proteases are the subtilisins, which are obtained from particular strains of *B. subtilis* and *B. licheniformis*. One suitable protease is obtained from a strain of Bacillus, having maximum activity throughout the pH range of 8–12, developed and sold as ESPERASE™ by Novo Industries A/S of Denmark, hereinafter "Novo". The preparation of this enzyme and analogous enzymes is described in GB 1,243,784 to Novo. Other suitable proteases include ALCALASE™ and SAVINASE™ from Novo and MAXATASE™ from International Bio-Synthetics, Inc., The Netherlands; as well as Protease A as disclosed in EP 130,756 A, and Protease B as disclosed in EP 303,761 A and EP 130,756 A. See also a high pH protease from Bacillus sp. NCIMB 40338 described in WO 9318140 A to Novo. Enzymatic detergents comprising protease, one or more other enzymes, and a reversible protease inhibitor are described in WO 9203529 A. Other preferred proteases include those of WO 9510591 A. When desired, a protease having decreased adsorption and increased hydrolysis is available as described in WO 9507791. A recombinant trypsin-like protease for detergents suitable herein is described in WO 9425583.

Useful proteases are also described in PCT publications: WO 95/30010, WO 95/30011, WO 95/29979.

Preferred proteolytic enzymes are also modified bacterial serine proteases, such as those described in EP-A-251446 (particularly pages 17, 24 and 98), and which is called herein "Protease B", and in EP-A- 199404, which refers to a modified bacterial serine proteolytic enzyme which is called "Protease A" herein, Protease A as disclosed in EP-A-130756.

Amylases suitable herein include, for example, alpha-amylases described in GB 1,296,839 to Novo; RAPIDASE™, (International Bio-Synthetics, Inc.) and TERMAMYL™, (Novo). FUNGAMYL™ from Novo is especially useful.

See, for example, references disclosed in WO 9402597. Stability-enhanced amylases can be obtained from Novo or from Genencor International. One class of highly preferred amylases herein have the commonality of being derived using site-directed mutagenesis from one or more of the Baccillus amylases, especially the Bacillus cc-amylases, regardless of whether one, two or multiple amylase strains are the immediate precursors.

Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to WO 9402597, known as TERMAMYL™, Particularly preferred amylases herein include amylase variants having additional modification in the immediate parent as described in WO 9510603 A and are available from the assignee, Novo, as DURAMYL™. Other particularly preferred oxidative stability enhanced amylase include those described in WO 9418314 to Genencor International and WO 9402597 to Novo or WO 9509909 A to Novo.

Cellulases usable herein include both bacterial and fungal types, preferably having a pH optimum between 5 and 9.5. U.S. Pat. No. 4,435,307 discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME™ (Novo) is especially useful. See also WO 9117243.

Suitable lipase enzymes for detergent usage include those produced by micro-organisms of the Pseudomonas group, such as Pseudomonas stutzeri ATCC 19.154, as disclosed in GB 1,372,034. See also lipases in Japanese Patent Application 53,20487. This lipase is available from Amano Pharmaceutical Co. Ltd., Nagoya, Japan, under the trade name Lipase P "Amano," or "Amano-P." Other suitable commercial lipases include Amano-CES, lipases ex Chromobacter viscosum, e.g. Chromobacter viscosum var. lipolyticum NRRLB 3673 from Toyo Jozo Co., Tagata, Japan; Chromobacter viscosum lipases from U.S. Biochemical Corp., U.S.A. and Disoynth Co., The Netherlands, and lipases ex Pseudomonas gladioli. LIPOLASE™ enzyme derived from Humicola lanyginosa and commercially available from Novo, see also EP 341,947, is a preferred lipase for use herein. Lipase and amylase variants stabilised against peroxidase enzymes are described in WO 9414951 A to Novo. See also WO 9205249. Cutinase enzymes suitable for use herein are described in WO 8809367 A to Genencor.

The preferred liquid laundry detergent compositions according to the present invention further comprise at least 0.001% by weight, of a protease enzyme. However, an effective amount of protease enzyme is sufficient for use in the liquid laundry detergent compositions described herein. The term "an effective amount" refers to any amount capable of producing a cleaning, stain removal, soil removal, whitening, deodorising, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase.

Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al.

Surfactant

The compositions herein comprise from 10 to 70% by weight of an anionic, nonionic, cationic, zwitterionic active detergent material or mixtures thereof. Preferably the compositions herein comprise 12 to 60% of surfactant, more preferably 15 to 40%.

Non-limiting examples of other surfactants useful herein typically at levels from about 10% to about 70%, by weight, include the conventional C11–C18 alkylbenzene sulphonates ("LAS"), the C10–C18 secondary (2,3) alkyl sulphates of the formula $CH3(CH2)_x(CHOS03–M+)CH3$ and $CH3(CH2)_y(CHOS03–M+)CH2CH3$ where x and (y+1) are integers of at least about 7, preferably at least about 9, and M is a water-solubilising cation, especially sodium, unsaturated sulphates such as oleyl sulphate, C10–C18 alkyl alkoxy carboxylates (especially the EO 1–7 ethoxycarboxylates), the C10–C18 glycerol ethers, the C10–C18alkyl polyglycosides and their corresponding sulphated polyglycosides, and C12–C18 alpha-sulphonated fatty acid esters. If desired, the conventional nonionic and amphoteric surfactants such as the C12–C18 alkyl ethoxylates ("AE") including the so-called narrow peaked alkyl ethoxylates and C6–C12 alkyl phenol alkoxylates (especially ethoxylates and mixed ethoxy/propoxy), C12–C18 betaines and sulphobetaines ("sultaines"), C10–C18 amine oxides, and the like, can also be included in the overall compositions. The C10–C18 N-alkyl polyhydroxy fatty acid amides can also be used. Typical examples include the C12–C18 N-methylglucamides. See WO 9,206,154. Other sugar-derived surfactants include the N-alkoxy polyhydroxy fatty acid amides, such as C10–C18 N-(3 -methoxypropyl) glucamide. C10–C20 conventional soaps may also be used. If high sudsing is desired, the branched-chain C10–C16 soaps may be used.

Mixtures of anionic and nonionic surfactants are especially useful. Other conventional useful surfactants are listed in standard texts.

Other anionic surfactants useful for detersive purposes can also be included in the compositions hereof. These can include salts (including, for example, sodium potassium, ammonium, and substituted ammonium salts such a mono-, di- and triethanolamine salts) of soap, C9–C20 linear alkylbenzenesulphonates, C8–C22 primary or secondary alkanesulphonates, C8–C24 olefinsulphonates, sulphonated polycarboxylic acids, alkyl glycerol sulphonates, fatty acyl glycerol sulphonates, fatty oleyl glycerol sulphates, alkyl phenol ethylene oxide ether sulphates, paraffin sulphonates, alkyl phosphates, isothionates such as the acyl isothionates, N-acyl taurates, fatty acid amides of methyl tauride, alkyl succinamates and sulphosuccinates, monoesters of sulphosuccinate (especially saturated and unsaturated C12–C18 monoesters) diesters of sulphosuccinate (especially saturated and unsaturated C6–C14 diesters), N-acyl sarcosinates, sulphates of alkylpolysaccharides such as the sulphates of alkylpolyglucoside, branched primary alkyl sulphates, alkyl polyethoxy carboxylates such as those of the formula $RO(CH2CH20)_kCH2COO—M+$ wherein R is a C8–C22 alkyl, k is an integer from 0 to 10, and M is a soluble salt-forming cation, and fatty acids esterified with isethionic acid and neutralised with sodium hydroxide. Further examples are given in Surface Active Agents and Detergents (Vol. I and II by Schwartz, Perry and Berch).

The compositions of the present invention preferably comprise at least about 5%, preferably at least 10%, more preferably at least 12% and less than 70%, more preferably less than 60% by weight, of an anionic surfactant.

Alkyl sulphate surfactants, either primary or secondary, are a type of anionic surfactant of importance for use herein. Alkyl sulphates have the general formula ROS03M wherein R preferably is a C10–C24 hydrocarbyl, preferably an alkyl straight or branched chain or hydroxyalkyl having a C10–C20 alkyl component, more preferably a C12–C18 alkyl or hydroxyalkyl, and M is hydrogen or a water soluble cation, e.g., an alkali metal cation (e.g., sodium potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like.

Typically, alkyl chains of C12–C16 are preferred for lower wash temperatures (e.g., below about 50° C. and C16–C18 alkyl chains are preferred for higher wash temperatures (e.g., about 50° C.).

Alkyl alkoxylated sulphate surfactants are another category of preferred anionic surfactant. These surfactants; are water soluble salts or acids typically of the formula RO(A) mSO3M wherein R is an unsubstituted C10–C24 alkyl or hydroxyalkyl group having a C10–C24 alkyl component, preferably a C12–C20 alkyl or hydroxyalkyl, more preferably C12–C18 alkyl or hydroxyalkyl, A is an ethoxy or propoxy unit, m is greater than zero, typically between about 0.5 and about 6, more preferably between about 0.5 and about 3, and M is hydrogen or a water soluble cation which can be, for example, a metal cation (e.g., sodium, potassium, lithium, calcium, magnesium, etc.), ammonium or substituted-ammonium cation. Alkyl ethoxylated sulphates as well as alkyl propoxylated sulphates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines, e.g., monoethanolamine, diethanolamine, and triethanolamine, and mixtures thereof. Exemplary surfactants are C12–C18 alkyl polyethoxylate (1.0) sulphate, C12–C18 alkyl polyethoxylate (2.25) sulphate, C12–C18 alkyl polyethoxylate (3.0) sulphate, and C12–C18 alkyl polyethoxylate (4.0) sulphate wherein M is conveniently selected from sodium and potassium.

The compositions of the present invention preferably comprise at least about 5%, preferably at least 10%, more preferably at least 12% and less than 70%, more preferably less than 60% by weight, of a nonionic surfactant.

Preferred nonionic surfactants such as C12–C18 alkyl ethoxylates ("AE") including the so-called narrow peaked alkyl ethoxylates and C6–C12 alkyl phenol alkoxylates (especially ethoxylates and mixed ethoxy/propoxy), block alkylene oxide condensate of C6 to C12 alkyl phenols, alkylene oxide condensates of C8–C22 alkanols and ethylene oxide/propylene oxide block polymers (Pluronic™-BASF Corp.), as well as semi polar nonionics (e.g., amine oxides and phosphine oxides) can be used in the present compositions. An extensive disclosure of these types of surfactants is found in U.S. Pat. No. 3,929,678.

Alkylpolysaccharides such as disclosed in U.S. Pat. No. 4,565,647 are also preferred nonionic surfactants in the compositions of the invention.

Further preferred nonionic surfactants are the polyhydroxy fatty acid amides.

A particularly desirable surfactant of this type for use in the compositions herein is alkyl-N-methyl glucamide.

Other sugar-derived surfactants include the N-alkoxy polyhydroxy fatty acid amides, such as C10–C18 N-(3-methoxypropyl) glucamide. The N-propyl through N-hexyl C12–C18 glucamides can be used for low sudsing. C10–C20 conventional soaps may also be used. If high sudsing is desired, the branched-chain C10–C16 soaps may be used.

Another preferred anionic surfactant is a salt of fatty acids. Examples of fatty acids suitable for use of the present invention include pure or hardened fatty acids derived from palmitoleic, safflower, sunflower, soybean, oleic, linoleic, linolenic, ricinoleic, rapeseed oil or mixtures thereof. Mixtures of saturated and unsaturated fatty acids can also be used herein.

It will be recognised &at the fatty acid will be present in the liquid detergent composition primarily in the form of a soap. Suitable cations include, sodium, potassium, ammonium, monoethanol ammonium diethanol ammonium, triethanol ammonium, tetraalkyl ammonium, e.g., tetra methyl ammonium up to tetradecyl ammonium etc. cations.

The amount of fatty acid will vary depending on the particular characteristics desired in the final detergent composition. Preferably 0 to 30%, more preferably 1–20 most preferably 5–15% fatty acid is present in the inventive composition.

Optional Ingredients

The compositions herein can further comprise a variety of optional ingredients. However, preferably they are substantially free of amine. A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the C10–C16 alkanolamides can be incorporated into the compositions, typically at 1%–10% levels. The C10–C14 monoethanol and diethanol amides illustrate a typical class of such suds boosters. Use of such suds boosters with high sudsing; adjunct surfactants such as the amine oxides, betaines and sultaines noted above is also advantageous. If desired, soluble magnesium salts such as MgC12, MgSO4, and the like, can be added at levels of, typically,0.1%–2%, to provide additional suds and to enhance grease removal performance.

Various detersive ingredients employed in the present compositions optionally can be further stabilised by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

By this means, ingredients such as the aforementioned enzymes, bleaches, bleach activators, bleach catalysts, photo-activators, dyes, fluorescers, fabric conditioners and hydrolysable surfactants can be "protected" for use in detergents, including liquid laundry detergent compositions.

Liquid detergent compositions can contain water and other solvents as carriers.

Low molecular weight primary or secondary alcohols exemplified by methanol, ethanol, propanol, and isopropanol are suitable. Monohydric alcohols are preferred for solubilising surfactant. The compositions may contain from 5% to 90%, typically 10% to 50% of such carriers.

The clarity of the compositions according to the present invention does not preclude the composition being coloured, e.g. by addition of a dye, provided that it does not detract substantially from clarity. Moreover, an opacifier could be included to reduce clarity if required to appeal to the consumer. In that case the definition of clarity applied to the composition according to any aspect of the invention will apply to the base (equivalent) composition without the opacifier.

The detergent compositions herein will preferably be formulated such that, during use in aqueous cleaning operations, the wash water will have a pH of between about 6.0 and about 11, preferably between about 7.0 and 10.0. Laundry liquid products are typically at pH 7–9. Techniques for controlling pH at recommended usage levels include the use of buffers, alkalis, acids, etc., and are well known to those skilled in the art.

Builders

Detergent builders can optionally be included in the compositions herein to assist in controlling mineral hardness. Inorganic as well as organic builders can be used.

Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Lower or higher levels of builder, however, are not meant to be excluded.

Inorganic or P-containing detergent builders include, but are not limited to, the alkali metal, ammonium and alkanolammonium. salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a SiO2:Na2O ratio in the range 1.6:1 to 3.2:1 and layered silicates, such as the layered sodium silicates described in U.S. Pat. No. 4,664,839.

Examples of carbonate builders are the alkaline earth and alkali metal carbonates as disclosed in German Patent Application No. 2,321,001 published on Nov. 15, 1973.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralised salt. When utilised in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287 and Lamberti et al, U.S. Pat. No. 3,635,830.

See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof Citrate builders, e.g., citric acid and soluble salts thereof (particularly sodium salt), are polycarboxylate builders of particular importance for heavy duty liquid detergent formulations due to their availability from renewable resources and their biodegradability. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the C5–C20 alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Lauryl succinates are the preferred builders of this group, and are described in European Patent Application 86200690.5/0, 200,263, published Nov. 5, 1986.

Fatty acids, e.g., C12–C18 monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders (see, for example, U.S. Pat. Nos. 3,159,581; 3,213,030; 3,422,021; 3,400,148 and 3,422,137) can also be used.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined.

If utilised, these chelating agents will generally comprise from about 0.1% to about. 10% by weight of the detergent compositions herein. More preferably, if utilised, the chelating agents will comprise from about 0.1% to about 3.0% by weight of such compositions.

Clay Soil Removal/Anti-Redeposition Agents

The compositions of the present invention can also optionally contain water-soluble ethoxylated amines having clay soil removal and anti-redeposition properties.

Liquid detergent compositions typically contain about 0.01% to about 5%.

One preferred soil release and anti-redeposition agent is ethoxylated tetraethylenepentamine. Exemplary ethoxylated amines are further described in U.S. Pat. No. 4,597,898, Another type of preferred anti-redeposition agent includes the carboxy methyl cellulose (CMC) materials. These materials are well known in the art.

Polymeric -Dispersing Agents

Polymeric dispersing agents can advantageously be utilised at levels from about 0.1% to about 7%, by weight, in the compositions herein. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptisation, and anti-redeposition.

Unsaturated monomeric acids that can be polymerised to form suitable polymeric polycarboxylates include acrylic acid, maleic acid (or maleic anhydride), fumaric acid, itaconic acid, aconitic acid, mesaconic acid, citraconic acid and methylenemalonic acid.

Particularly suitable polymeric polycarboxylates can be derived from acrylic acid. Such acrylic acid-based polymers that are useful herein are the water-soluble salts of polymerised acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material that can be included is polyethylene glycol (PEG). PEG can exhibit dispersing agent performance as well as act as a clay soil removal-anti-redeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used. Dispersing agents such as polyaspartate preferably have a molecular weight (avg.) of about 10,000.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic C18–C40 ketones (e.g., stearone), etc.

The preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779.

For any detergent compositions to be used in automatic laundry washing machines, suds should not form to the extent that they overflow the washing machine.

Suds suppressors, when utilised, are preferably present in a "suds suppressing amount".

By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0.1% to about 5% of suds suppressor.

Fabric Softeners

Various through-the-wash fabric softeners, especially the impalpable smectite clays of U.S. Pat. No. 4,062,647 as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. Nos. 4,375,416 and 4,291,071.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

Other than in the examples, or where otherwise indicated, all numbers expressing quantities of ingredients or reaction conditions used herein are to be understood as modified in all instances by the term "about". Similarly, all percentages are weight/weight percentages of the composition unless otherwise indicated. Where the term "comprising" is used in the specification or claims, it is not intended to exclude any terms, steps or features not specifically recited.

The invention is more fully illustrated by the following non-limiting examples showing some preferred embodiments of the invention.

EXAMPLES

Example 1–4 and Comparative Example A

Concentrated Isotropic Liquid Detergent Compositions

The following composition was prepared with different levels of carbohydrate and borate.

| Component | % w/w |
|---|---|
| Na-Linear Alkyl benzene sulphonate | 7.0 |
| Na LES | 11.6 |
| Alcohol ethoxylate (Synperonic A7) | 7.0 |
| Carbohydrate | see table |
| Na-Borate.5aq | see table |
| Na-citrate | 5.0 |
| Propylene glycol (mostly from NaLES) | 3.42 |
| Mono Ethanol Amine | 0.24 |
| Coconut Fatty Acid | 0.85 |
| Protease (Purafect 4000L) | 0.3 |
| NaOH to pH | 8.0 |
| Water and minors | up to 100% |

Enzyme Stability Results

The enzyme stability results are given in the table below.

| % | A | 1 | 2 | 3 | 4 |
|---|---|---|---|---|---|
| Carbo-hydrate | 0 | 20 | 0 | 10 | 10 |
| Borate | 0 | 0 | 1 | 1 | 2 |
| Protease % Rest-Activity | 2 | 50 | 29 | 57 | 72 |

(Carbohydrate = sucrose)

The comparative example A and examples 1–4 according the invention were stored for 2 weeks at 37° C. After this period the rest activity of the enzyme was determined. All compositions were physically stable after this period. The results of the examples 1–4 according the invention demonstrate that carbohydrate can improve protease stability quite considerably, while the composition remains physically stable.

Examples 5 and 6 and Comparative Example B and C

The following compositions were prepared to determine the effect of sulphite salt on the physical stability of the liquid detergent compositions.

| | B | C | 5 | 6 |
|---|---|---|---|---|
| Na-Linear Alkyl benzene sulphonate | 7.0 | 7.0 | 7.0 | 7.0 |
| NaLES | 11.6 | 11.6 | 11.6 | 11.6 |
| Alcohol ethoxylate Synperonic A7 | 7.0 | 7.0 | 7.0 | 7.0 |
| NaBorate | 2 | 2 | 2 | 2 |
| Carbohydrate | 2 | 10 | 2 | 10 |
| Sulphite | 5 | 5 | 0 | 0 |
| Na-Citrate | 5 | 5 | 5 | 5 |
| Propylene glycol | 3.42 | 3.42 | 3.42 | 3.42 |
| MEA | 0.24 | 0.24 | 0.24 | 0.24 |
| Coconut fatty acid | 0.85 | 0.85 | 0.85 | 0.85 |
| Purafect 4000L | 0.3 | 0.3 | 0.3 | 0.3 |
| Lipolase 100 LEX | 0.4 | 0.4 | 0.4 | 0.4 |
| NaOH to pH | 8.0 | 8.0 | 8.0 | 8.0 |
| Water to 100% | to 100% | to 100% | to 100% | To 100% |

(Carbohydrate = sucrose)

Comparative examples B and C with the minimal level of sulphite of 5 wt % as disclosed in U.S. Pat. No. 4,462,922 were physically unstable and had a hazy appearance. Comparative examples B and C were not isotropic. Examples 5 and 6 according the invention were isotropic and physically stable.

What is claimed is:

1. A physically stable, concentrated isotropic liquid detergent composition comprising (a) from 10 to 70% of an anionic, nonionic, cationic, zwitterionic active detergent material or mixtures thereof;

(b) from 0.0001 to 10% of protease;

(c) from 2 to 40% of at least one carbohydrate selected from the group consisting of oligosaccharides, polysaccharides and derivatives thereof; and (d) less than 3% of an antioxidant selected from the group consisting of alkalimetalsulphites, alkalimetalbisulphites, and alkalimetalthiosulphates.

2. The composition of claim 1, wherein the carbohydrate is an oligosaccharide.

3. The composition of claim 1, wherein the composition further comprises more than 0.1 and less than 5% of a boron compound.

4. The composition of claim 1, wherein the composition comprises 15 to 40 wt % of detergent material.

5. The composition of claim 1, wherein the composition further comprises at least 0.0001% to 10% of an enzyme selected from the group consisting of lipase, cellulase, peroxidase amylase and mixtures thereof.

6. The composition of claim 1, wherein the composition comprises 5 to 30% of the carbohydrate.

7. The composition of claim 1, wherein the carbohydrate comprises sucrose or trehalose.

8. A method for the stabilisation of protease in a physically stable concentrated isotropic liquid detergent composition, the method comprising the steps of (I) formulating said composition comprising (a) from 10 to 70% of an anionic, nonionic, cationic, zwitterionic active detergent material or mixtures thereof, (b) from 0.0001% to 10% of protease; and (c) less than 3% of an antioxidant selected from the group consisting of alkalimetalsulphites, alkalimetalbisulphites, and alkalimetalthiosulphates, and (II) adding 2 to 40% of at least one carbohydrate selected from the group consisting of oligosaccharides, polysaccharides and derivatives thereof, to the composition prepared in step (I).

9. The method of claim 8, wherein the composition is a physically stable, concentrated isotropic liquid detergent composition comprising (a) from 10 to 70% of an anionic, nonionic, cationic, zwitterionic active detergent material or mixtures thereof;

(b) from 0.0001 to 10% of protease;

(c) from 2 to 40% of at least one carbohydrate $C_{6n}(H_2O)_{6n}$ and derivatives thereof, wherein n=1–5; and (d) less than 3% of an antioxidant selected from the group consisting of alkalimetalsulphites, alkalimetalbisulphites, and alkalimetalthiosulphates.

10. The composition of claim 2, wherein the oligosaccharide is selected from the group consisting of disaccharides and their derivatives, trisaccharides and their derivatives, and mixtures thereof.

11. The composition of claim 1, wherein the composition further comprises more than 0.1 and less than 3% of a boron compound.

12. The composition of claim 1, wherein the composition further comprises more than 0.1 and less than 2.5% of a boron compound.

13. The composition of claim 1, wherein the composition comprises 8 to 25% of the carbohydrate.

* * * * *